US010056031B2

(12) United States Patent
Park

(10) Patent No.: US 10,056,031 B2
(45) Date of Patent: Aug. 21, 2018

(54) DATA DRIVER AND DISPLAY DEVICE USING THE SAME

(71) Applicant: LG DISPLAY CO., LTD., Seoul (KR)

(72) Inventor: Subin Park, Jeonju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 16 days.

(21) Appl. No.: 14/981,039

(22) Filed: Dec. 28, 2015

(65) Prior Publication Data

US 2016/0189608 A1 Jun. 30, 2016

(30) Foreign Application Priority Data

Dec. 29, 2014 (KR) ..... 10-2014-0191929

(51) Int. Cl.
*G09G 3/32* (2016.01)
*G09G 3/3225* (2016.01)
*G09G 3/3275* (2016.01)

(52) U.S. Cl.
CPC ..... *G09G 3/3225* (2013.01); *G09G 3/3275* (2013.01); *G09G 2310/08* (2013.01); *G09G 2320/0242* (2013.01); *G09G 2330/022* (2013.01); *G09G 2330/027* (2013.01)

(58) Field of Classification Search
None
See application file for complete search history.

(56) References Cited

U.S. PATENT DOCUMENTS 7,932,631 B2 * 4/2011 Chen ..... G06F 1/26 307/113
9,324,261 B2 * 4/2016 Lee ..... G09G 3/3208
2009/0086520 A1 * 4/2009 Nishimura ..... H02M 3/33576 363/133

(Continued)

FOREIGN PATENT DOCUMENTS

CN 101221745 A 7/2008
CN 102411898 A 4/2012

(Continued)

OTHER PUBLICATIONS

Sarma G H, Nitin G, Ramanan, Manivannan, Mehta Kaushik, Bhattacharjee Arya. (Sep. 29, 2009). Reliability Studies on High Current Power Modules with Parallel MOSFETs. IEEE.*

*Primary Examiner* — William Boddie
*Assistant Examiner* — Bipin Gyawali
(74) *Attorney, Agent, or Firm* — Birch, Stewart, Kolasch & Birch, LLP

(57) ABSTRACT

Provided is a data driver for a display panel. The data driver includes an auxiliary power generating unit and an auxiliary power output unit. The auxiliary power generating unit may generate an auxiliary power. The auxiliary power output unit may supply the auxiliary power to the display panel when the display panel is driven in a power saving mode under the control of the auxiliary power generating unit. The auxiliary power output unit may include a first transistor configured to output the auxiliary power output from the auxiliary power generating unit, a diode configured to output the auxiliary (Continued)

power output from the first transistor, and a second transistor connected to the diode in parallel and configured to output the auxiliary power together with the diode.

8 Claims, 8 Drawing Sheets

(56) References Cited

U.S. PATENT DOCUMENTS

| | | | | |
|---|---|---|---|---|
| 2009/0167748 | A1* | 7/2009 | Mori | G09G 3/294 345/212 |
| 2012/0069059 | A1* | 3/2012 | Lee | G09G 3/3225 345/690 |
| 2012/0092043 | A1* | 4/2012 | Nierop | H03K 17/6874 327/109 |
| 2014/0346878 | A1* | 11/2014 | Umeyama | H03K 3/012 307/52 |

FOREIGN PATENT DOCUMENTS

| | | | |
|---|---|---|---|
| CN | 102426820 | A | 4/2012 |
| CN | 102457164 | A | 5/2012 |

* cited by examiner

DATA DRIVER AND DISPLAY DEVICE USING THE SAME

CROSS-REFERENCE TO RELATED APPLICATIONS

This application claims the priority benefit of the Korean Patent Application No. 10-2014-0191929, filed on Dec. 29, 2014, which is incorporated herein by reference for all purposes as if fully set forth herein.

BACKGROUND OF THE INVENTION

Field of the Invention

The present invention relates to a data driver and a display device using the same.

Description of the Related Art

As the information technology has advanced, the market of display devices as mediums connecting users and information has grown. In line with this, the use of display device such as liquid crystal displays (LCDs), organic light emitting display devices, electrophoretic displays (EPDs), and plasma display panels (PDPs) has increased.

Some of the aforementioned display devices, for example, an LCD device or an organic light emitting display device, includes a display panel including a plurality of subpixels disposed in a matrix form and a driver driving the display panel. The driver includes a scan driver supplying a scan signal (or a gate signal) to the display panel and a data driver supplying a data signal to the display panel.

In the display device, when the display panel emits light or allows light to be transmitted therethrough on the basis of power output from a power supply unit and a scan signal and a data signal respectively output from the scan driver and the data driver, a specific image is displayed.

The aforementioned display devices tend to be applied to and used in small display devices or wearable display devices (for example, watches or glasses) aiming at low power consumption.

Since small display devices or wearable display devices use a battery as a main power source, a power saving mode is used to minimize battery consumption. However, the conventionally proposed power saving scheme has difficulty in supplying stable power to a display panel when switching to the power saving mode, which leads to a difference in color sense or appearance of mura on a screen, which is required to be improved.

SUMMARY OF THE INVENTION

An aspect of the present disclosure provides a data driver including an auxiliary power generating unit and an auxiliary power output unit. The auxiliary power generating unit may generate auxiliary power. The auxiliary power output unit may output auxiliary power under the control of the auxiliary power generating unit. The auxiliary power output unit may include a first transistor configured to output auxiliary power output from the auxiliary power generating unit, a diode configured to output auxiliary power output from the first transistor, and a second transistor connected to the diode in parallel and configured to output auxiliary power together with the diode.

Another aspect of the present disclosure provides a display device including a display panel, a power supply unit, and a data driver. The display panel may display an image. The power supply unit may supply power to the display panel. The data driver may have an auxiliary power generating unit configured to supply a data signal to the display panel and generate auxiliary power and an auxiliary power output unit configured to output the auxiliary power under the control of the auxiliary power generating unit, and supply auxiliary power to the display panel when driven in a power saving mode. The auxiliary power output unit may include a first transistor configured to output auxiliary power output from the auxiliary power generating unit, a diode configured to output the auxiliary power output from the first transistor, and a second transistor connected to the diode in parallel and configured to output auxiliary power together with the diode.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

DETAILED DESCRIPTION OF EMBODIMENTS

Reference will now be made in detail to embodiments of the invention examples of which are illustrated in the accompanying drawings.

Hereinafter, specific embodiments of the present disclosure will be described with reference to the accompanying drawings.

A display device, as a small display device, according to an embodiment of the present disclosure is implemented as a navigation device, a video player, a personal computer (PC), a wearable device (a watch or glasses), or a mobile phone (smartphone). As a display panel of the display device, a liquid crystal display panel, an organic light emitting display panel, an electrophoretic display panel, or a plasma display panel may be selected, but the present disclosure is not limited thereto. Hereinafter, for the purposes of description, an organic light emitting display device will be described as an example.

Figure 1:
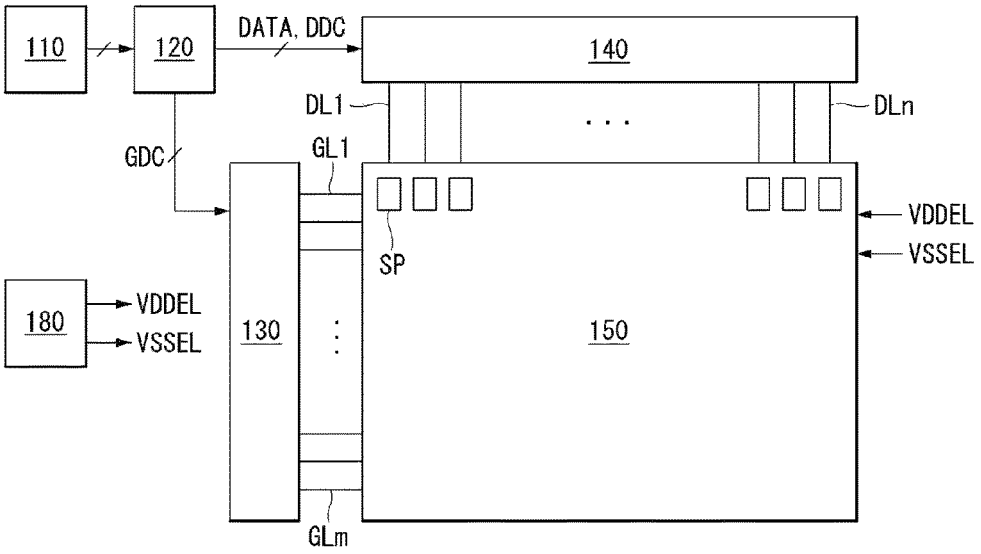
FIG. 1 is a block diagram schematically illustrating an organic light emitting display device according to an embodiment of the present invention.
Figure 2:
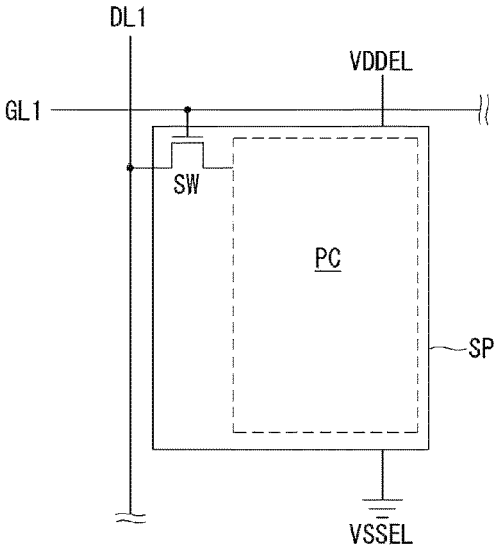
FIG. 2 is a view schematically illustrating a subpixel illustrated in FIG. 1.
Figure 3:
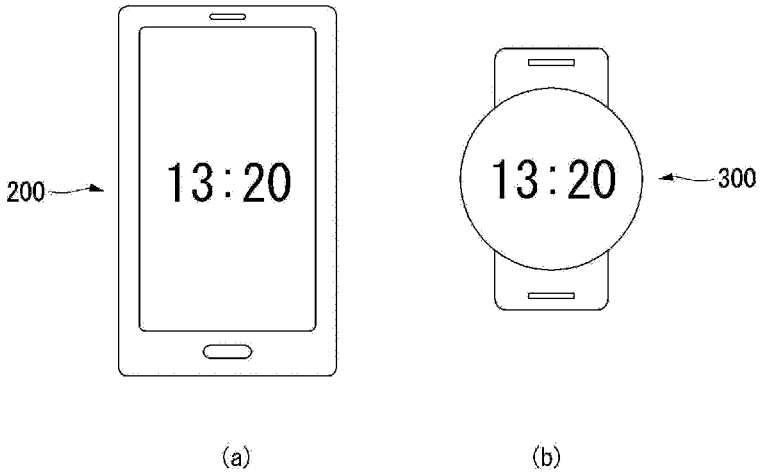
FIG. 3 is a view illustrating an application example of a small display device according to an embodiment of the present invention.

FIG. 1 is a block diagram schematically illustrating an organic light emitting display device, FIG. 2 is a view schematically illustrating a subpixel illustrated in FIG. 1, and FIG. 3 is a view illustrating an application example of a small display device.

As illustrated in FIG. 1, an organic light emitting display device includes an image supply unit 110, a timing controller 120, a scan driver 130, a data driver 140, a display panel 150, and a power supply unit 180.

The display panel 150 displays an image in response to a scan signal and a data signal DATA output from a driver including a scan driver 130 and a data driver 140. The display panel 150 is implemented according to a top emission scheme, a bottom-emission scheme, or a dual-emission scheme.

The display panel 150 may be implemented as a flat type, a curved type, or a flexible type according to materials of a substrate. In the display panel 150, subpixels SP positioned between two substrates emit light in response to a driving current.

As illustrated in FIG. 2, one subpixel includes a switching transistor SW connected to a scan line GL1 and a data line DL1 (or formed at an intersection therebetween) and a pixel circuit PC operating in response to a data signal DATA supplied through the switching transistor SW. The pixel circuit PC includes circuits such as a driving transistor, a storage capacitor, and an organic light emitting diode (OLED), and a compensation circuit for performing compensation in relation to these circuits.

In the subpixel, when the driving transistor is turned on in response to a data voltage stored in the storage capacitor, a driving current is supplied to the OLED positioned between a first power line VDDEL and a second power line VSSEL. The OLED emits light in response to the driving current.

The compensation circuit is a circuit for compensating for a threshold voltage, or the like, of the driving transistor. The compensation circuit includes one or more thin film transistors (TFTs) and a capacitor. A configuration of the compensation circuit may be varied according to compensation methods, and thus, a specific example and descriptions thereof will be omitted. The TFTs are implemented on the basis of low temperature polysilicon (LIPS), amorphous silicon (a-Si), an oxide, or an organic semiconductor layer.

The image supply unit 110 image-processes a data signal, and outputs the processed data signal together with a vertical synchronization signal, a horizontal synchronization signal, a data enable signal, and a clock signal. The image supply unit 110 supplies the vertical synchronization signal, the horizontal synchronization signal, the data enable signal, the clock signal, and the data signal to the timing controller 120. The image supply unit 110 is also termed a system or main control unit.

The timing controller 120 receives the data signal, or the like, from the image supply unit 110 and outputs a gate timing control signal GDC for controlling an operation timing of the scan driver 130 and a data timing control signal DDC for controlling an operation timing of the data driver 140. The timing controller 120 supplies the data signal DATA together with the data timing control signal DDC to the data driver 140.

The scan driver 130 outputs a scan signal, while shifting a level of a gate voltage, in response to the gate timing control signal GDC supplied from the timing controller 120. The scan driver 130 includes a level shifter and a shift register. The scan driver 130 supplies a scan signal to the subpixels SP included in the display panel 150 through scan line GL1 to GLm. The scan driver 130 may be formed in a gate-in-panel manner or in the form of an integrated circuit (IC). A portion formed in the gate-in-panel manner in the scan driver 130 is the shift register.

In response to the data timing control signal DDC supplied from the timing controller, the data driver 140 samples and latches the data signal DATA, and converts a digital signal into an analog signal to correspond to a gamma reference voltage, and outputs the converted analog signal. The data driver 140 supplies the data signal DATA to the subpixels SP included in the display panel 150 through the data lines DL1 to DLn. The data driver 140 may be formed in the form of an IC.

The power supply unit 180 generates the first power VDDEL and the second power VSSEL to be supplied to the display panel 150. The first power VDDEL is a high potential power, and the second power VSSEL is a low potential power. The power supply unit 180 generates a power to be supplied to the scan driver 130 or the data driver 140, as well as the power VDDEL and VSSEL to be supplied to the display panel 150, on the basis of an input power supplied from the outside.

The display device described above displays a specific image as the display panel 150 emits light on the basis of the power VDDEL and VSSEL output from the power supply unit 180 and the scan signal and the data signal DATA respectively output from the scan driver 130 and the data driver 140.

As illustrated in (a) and (b) of FIG. 3, a display device described hereinafter may be implemented as a wearable display device such as a clock 200 having a quadrangular shape and a clock 300 having a circular shape. Also, the display device described hereinafter may be implemented as other small display devices.

Since such small display devices or wearable display devices use a battery as a main power source, a power saving mode is used to minimize battery consumption. However, the conventionally proposed power saving scheme has difficulty in supplying stable power to a display panel when switching to the power saving mode, which leads to a difference in color sense or appearance of blurs on a screen, which is required to be improved. Hereinafter, problems of an experimental example will be considered and the present disclosure will be described.

Figure 4:
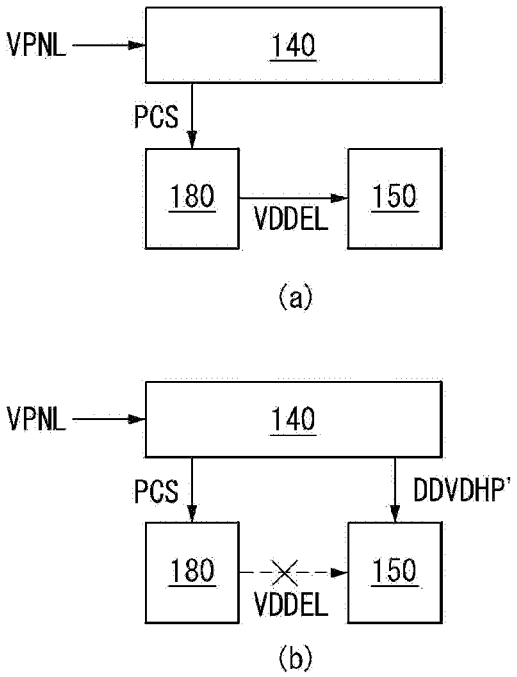
FIG. 4 is a block diagram illustrating a driving scheme according to a mode of a display device according to an experimental example of the present invention.
Figure 5:
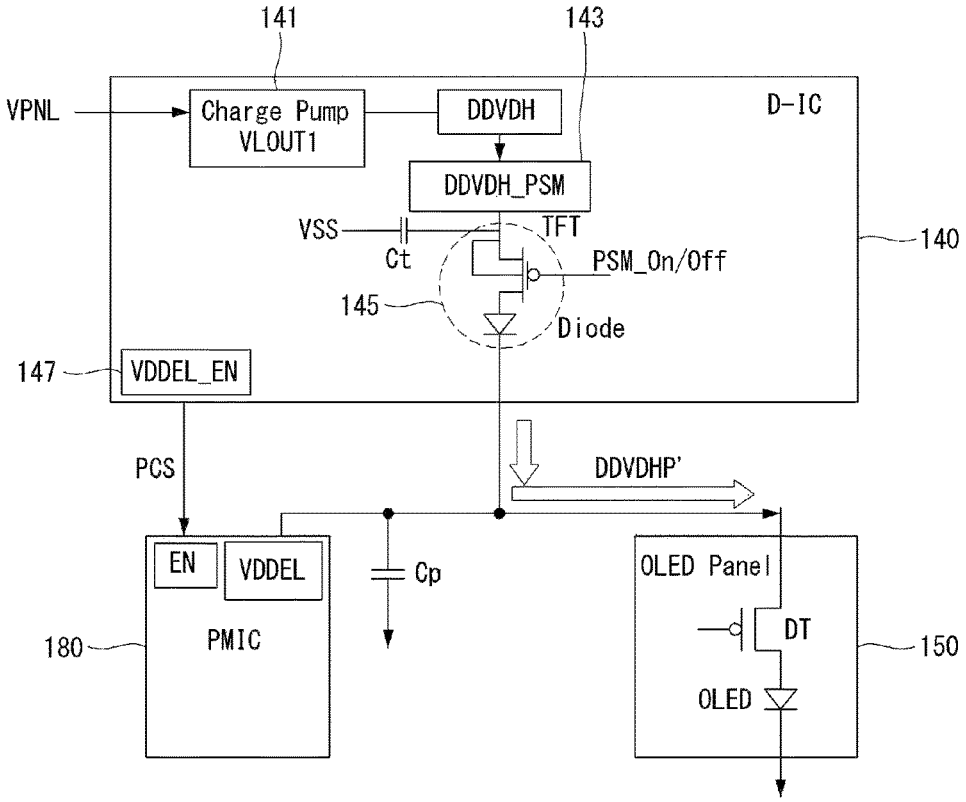
FIG. 5 is a circuit diagram illustrating a portion of a display device according to an experimental example of the present invention.
Figure 6:
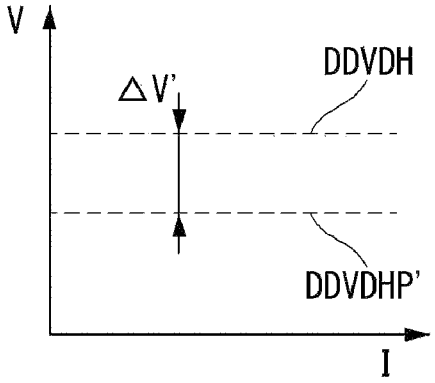
FIG. 6 is an output voltage waveform view illustrating a problem of a data driver of an experimental example.

FIG. 4 is a block diagram illustrating a driving scheme according to a mode of a display device according to an experimental example, FIG. 5 is a circuit diagram illustrating a portion of a display device according to an experimental example, and FIG. 6 is an output voltage waveform view illustrating a problem of a data driver of an experimental example.

Experimental Example

As illustrated in FIG. 4, a display device according to an experimental example includes a data driver 140, a power supply unit 180, and a display panel 150. Other circuit units are not greatly related to the following descriptions and thus omitted.

The data driver 140 is driven on the basis of input power VPNL. The input power VPNL is power generated by a battery included in the display device or power generated on the basis of power output from the battery. In general, as the input power VPNL, power generated on the basis of power output from the battery is used.

The power supply unit 180 generates a first power VDDEL on the basis of a power output from the battery. Whether or not the power supply unit 180 outputs the first power VDDEL is determined based on a power control signal PCS output from the data driver 140.

For example, when the display device is driven in a normal mode (non-power saving mode), the data driver 140 outputs the power control signal PCS as logic high in order to activate an output from the power supply unit 180. Then, as illustrated in (a) of FIG. 4, the power supply unit 180 is activated (turned on) in response to the power control signal PCS and outputs a first power VDDEL. As a result, the display panel 150 is driven on the basis of the first power VDDEL output from the power supply unit 180.

In contrast, when the display device is driven in a power saving mode, the data driver 140 outputs the power control signal PCS as logic low in order to deactivate an output from the power supply unit 180. Then, as illustrated in (b) of FIG. 4, the power supply unit 180 is deactivated (turned off) in response to the power control signal PCS and does not output the first power VDDEL.

Here, the data driver 140 generates and outputs auxiliary power DDVDHP' on the basis of the input power VPNL supplied to an input terminal of the data driver 140, instead of the power supply unit 180. As a result, the display panel 150 (an OLED panel) is driven on the basis of the auxiliary power DDVDHP' output from the data driver 140 instead of the first power VDDEL output from the power supply unit 180. The auxiliary power DDVDHP' has a voltage level lower than that of the first power VDDEL. For example, the auxiliary power DDVDHP' is set to about 5.5V, while the first power VDDEL is set to 8V higher than the auxiliary power DDVDHP'.

As illustrated in FIGS. 5 and 6, the data driver (or a D-IC) 140 of the experimental example includes a driving power generating unit (charge pump) 141, an auxiliary power generating unit (or a DDVDH_PSM) 143, an auxiliary power output unit 145, and a power control unit (or a VDDEL_EN) 147.

In FIG. 5, Cp refers to a parasitic capacitor present in an output terminal of the power supply unit 180, VSS refers to a ground line, Ct refers to an output capacitor of the auxiliary power generating unit 143, DT refers to a driving transistor of a subpixel, OLED refers to an organic light emitting diode of the subpixel, EN refers to a signal input terminal of the power supply unit (or a PMIC) 180, and VDDEL refers to a first power output terminal of the power supply unit 180.

When the auxiliary power output unit 145 is turned on, the data driver 140 of the experimental example outputs the auxiliary power DDVDHP' generated by the auxiliary power generating unit 143 to the display panel 150. In contrast, when the auxiliary power output unit 145 is turned off, the auxiliary power DDVDHP' generated by the auxiliary power generating unit 143 is not output to the display panel 150.

The auxiliary power output unit 145 included in the data driver of the experimental example includes a thin film transistor (TFT) and a diode. The TFT is turned on or off in response to an auxiliary power output signal (PSM On/Off) output from the auxiliary power generating unit 143. When the TFT is turned on, the display panel 150 receives the auxiliary power DDVDHP'.

In this manner, when the display panel 150 is driven on the basis of the auxiliary power DDVDHP', output from the power supply unit 180 is turned off (that is, a power generation operation of the power supply unit is stopped), reducing power consumption of the system.

However, the experimental example is not desirable because of the insufficient voltage margin for the display panel 150 to be stably driven due to increase in ON resistance (Ron) of the TFT and an output voltage drop of the diode included in the auxiliary power output unit 145 when the device is switched to a power saving mode.

As can be seen in the example of FIG. 6, in the data driver 140 of the experimental example, there is a significant voltage difference ΔV' between the auxiliary power DDVDHP' output from the auxiliary power output unit 145 and the driving power DDVDH output from the driving power generating unit 141.

The aforementioned experimental example is merely an experiment, but the power saving scheme conventionally proposed in such a form has difficulty in supplying stable power to the display panel 150 when the device is switched to a power saving mode, causing a difference in color sense or appearance of mura on a screen, which needs to be improved.

First Embodiment

Figure 7:
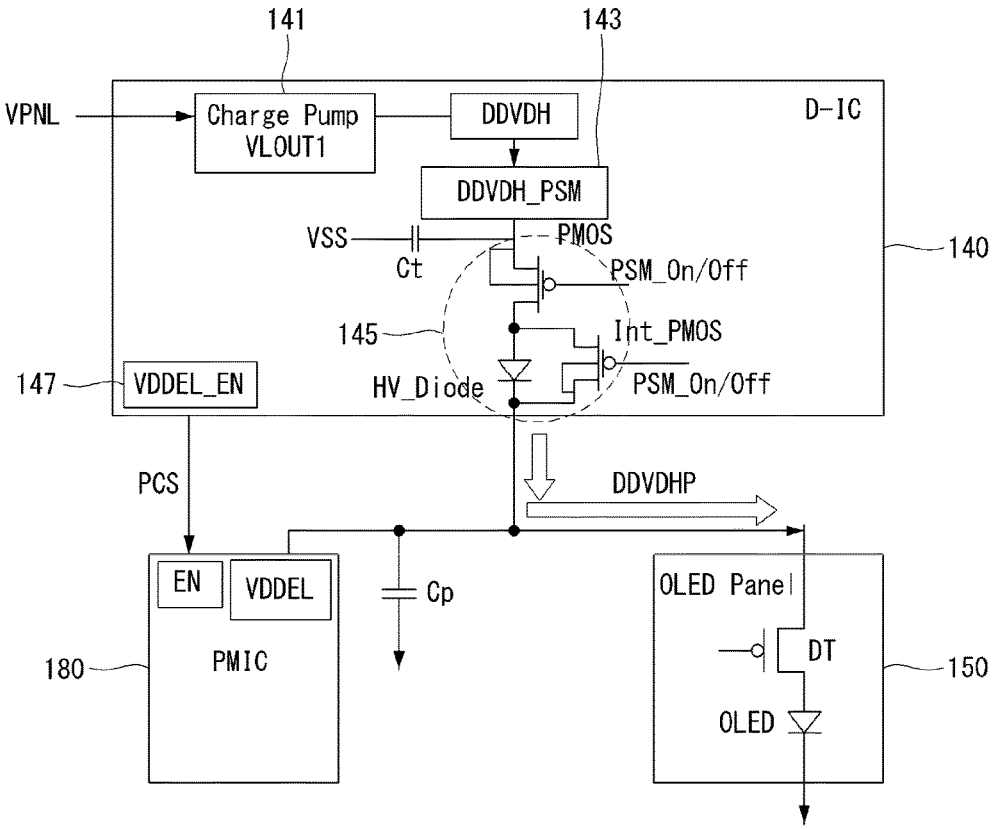
FIG. 7 is a circuit diagram illustrating a portion of a display device according to a first embodiment of the present invention.
Figure 8:
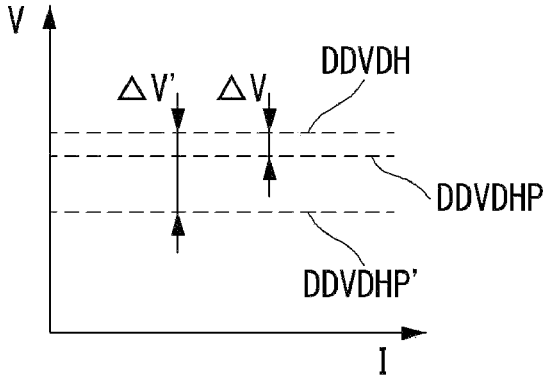
FIG. 8 is an output voltage waveform view illustrating improvement of a data driver according to the first embodiment of the present invention.

FIG. 7 is a circuit diagram illustrating a portion of a display device according to a first embodiment of the present disclosure, and FIG. 8 is an output voltage waveform view illustrating improvement of a data driver according to the first embodiment of the present disclosure.

As illustrated in FIGS. 7 and 8, the display device according to the first embodiment of the present disclosure include a data driver (or a D-IC) 140, a power supply unit (or a PMIC) 180, and a display panel (or an OLED panel) 150. Other circuit units are not greatly related to the following descriptions and thus are omitted.

The data driver 140 is driven on the basis of the input power VPNL. The data driver 140 includes a driving power generating unit (charge pump) 141, an auxiliary power generating unit (or a DDVDH_PSM) 143, an auxiliary power output unit 145, and a power control unit (or a VDDEL_EN) 147.

In FIG. 7, Cp refers to a parasitic capacitor present in an output terminal of the power supply unit 180, VSS refers to a ground line, Ct refers to an output capacitor of the auxiliary power generating unit 143, DT refers to a driving transistor of a subpixel, OLED refers to an organic light emitting diode of the subpixel, EN refers to a signal input terminal of the power supply unit (or a PMIC) 180, and VDDEL refers to a first power output terminal of the power supply unit 180.

The power control unit 147 generates and outputs a power control signal PCS for controlling the power supply unit 180. The power control unit 147 outputs the power control signal PCS corresponding to logic high or logic low under the control of the auxiliary power generating unit 143.

For example, when the display device is driven in a normal mode (non-power saving mode), the power control unit 147 outputs the power control signal PCS as logic high in order to activate an output from the power supply unit 180. Then, the power supply unit 180 is activated (turned on) in response to the power control signal PCS and outputs a first power VDDEL.

In contrast, when the display device is driven in a power saving mode, the power control unit 147 outputs the power control signal PCS as logic low in order to deactivate an output from the power supply unit 180. Then, the power supply unit 180 is deactivated (turned off) in response to the power control signal PCS and does not output the first power VDDEL.

The driving power generating unit 141 generates and outputs driving power DDVDH required for driving the data driving unit 140 on the basis of the input power VPNL. The driving power generating unit 141 may be implemented as a charge pump circuit.

The auxiliary power generating unit (or the DDVDH_PSM) 143 generates auxiliary power DDVDHP for driving the display panel 150 in a power saving mode on the basis of driving power DDVDH output from the driving power generating unit 141. When a power saving mode signal output from the outside (the timing controller or the image supply unit) is activated, the auxiliary power generating unit 143 outputs the auxiliary power DDVDHP for driving the display panel 150 in a power saving mode. The auxiliary power generating unit 143 outputs an auxiliary power output signal PSM On/Off for controlling the auxiliary power output unit 145.

The auxiliary power output unit 145 outputs the auxiliary power DDVDHP transferred from the auxiliary power generating unit 143 to the display panel 150. The auxiliary power output unit 145 outputs or does not output the auxiliary power DDVDHP under the control of the auxiliary power generating unit 143.

For example, when an auxiliary power output signal PSM On corresponding to turn-on (or logic low L) is output from the auxiliary power generating unit 143, the auxiliary power output unit 145 outputs the auxiliary power DDVDHP. In contrast, when an auxiliary power output signal PSM Off corresponding to turn-off (or logic high H) is output from the auxiliary power generating unit 143, the auxiliary power output unit 145 does not output the auxiliary power DDVDHP.

The auxiliary power output unit 145 included in the data driver 140 includes a first transistor PMOS, a second transistor Int_PMOS, and a diode HV_Diode. The auxiliary power output unit 145 included in the data driver 140 according to the first embodiment of the present disclosure includes the first transistor PMOS and the second transistor Int_PMOS configured as P type transistors, and the diode HV_Diode configured as a high voltage diode. The first transistor PMOS, the second transistor Int_PMOS, and the diode HV_Diode are positioned within the data driver 140.

The first transistor PMOS is turned on or turned off in response to an auxiliary power output signal (PSM On/Off) output from the auxiliary power generating unit 143. The first transistor PMOS transfers auxiliary power DDVDHP output from the auxiliary power generating unit 143 to the second transistor Int_PMOS.

A gate electrode of the first transistor PMOS is connected to the auxiliary power output signal line of the auxiliary power generating unit 143, a first electrode thereof is connected to an output terminal of the auxiliary power generating unit 143, and a second electrode thereof is connected to an anode electrode of the diode HV_Diode.

The second transistor Int_PMOS is turned on or turned off in response to the auxiliary power output signal PSM On/Off output from the auxiliary power generating unit 143. The second transistor Int_PMOS transfers auxiliary power DDVDHP transferred from the first transistor PMOS to an output terminal.

A gate electrode of the second transistor Int_PMOS is connected to the auxiliary power output signal line of the auxiliary power generating unit 143, a second electrode thereof is connected to the second electrode of the first transistor PMOS and an anode electrode of the diode HV_Diode, and a first electrode thereof is connected to a cathode electrode of the diode HV_Diode. The second transistor Int_PMOS is connected in parallel in order to reduce a voltage drop by the diode HV_Diode.

The diode HV_Diode serves to prevent first power VDDEL output from the power supply unit 180 from being introduced to the interior of the data driver 140.

When the auxiliary power output unit 145 is turned on, the data driver 140 according to the first embodiment of the present disclosure outputs auxiliary power DDVDHP generated by the auxiliary power generating unit 143 to the display panel 150. In contrast, when the auxiliary power output unit 145 is turned off, the data driver 140 does not output the auxiliary power DDVDHP generated by the auxiliary power generating unit 143 to the display panel 150.

In the first embodiment of the present disclosure, since the first transistor PMOS and the second transistor Int_PMOS are provided, output loss (voltage drop) generated by the diode HV_Diode, as well as ON resistance Ron, is lowered, reducing loss of output from the auxiliary power output unit 145.

When the display panel 150 is driven on the basis of the auxiliary power DDVDHP as in the first embodiment of the present disclosure, since output of the power supply unit 180 is turned off (that is, a power generation operation of the power supply unit is stopped), power consumption of the image supply unit (or system) may be reduced. Also, when the display panel 150 is driven using internal power of the data driver 140, power boost efficiency is improved in right loading, and since a relatively low voltage compared with the first power is used, power consumption of the display panel may be reduced.

Referring to FIG. 8 illustrating the example, it can be seen that, in the data driver 140 of the first embodiment, a voltage difference $\Delta V$ between the auxiliary power DDVDHP output from the auxiliary power output unit 145 and the driving power DDVDH output from the driving power generating unit 141 is lower than that of the experimental example. That is, in the present disclosure, the voltage difference ($\Delta V<\Delta V'$) between the driving power DDVDH and the auxiliary power DDVDHP may be significantly reduced compared with the experimental example. Therefore, in the present disclosure, when the display panel 150 is switched to a power saving mode, a stable voltage may be supplied to the display panel 150 with a sufficient voltage margin, compared with the experimental example, whereby the problem of a difference in color sense or appearance of mura on the screen may be solved.

Second Embodiment

Figure 9:
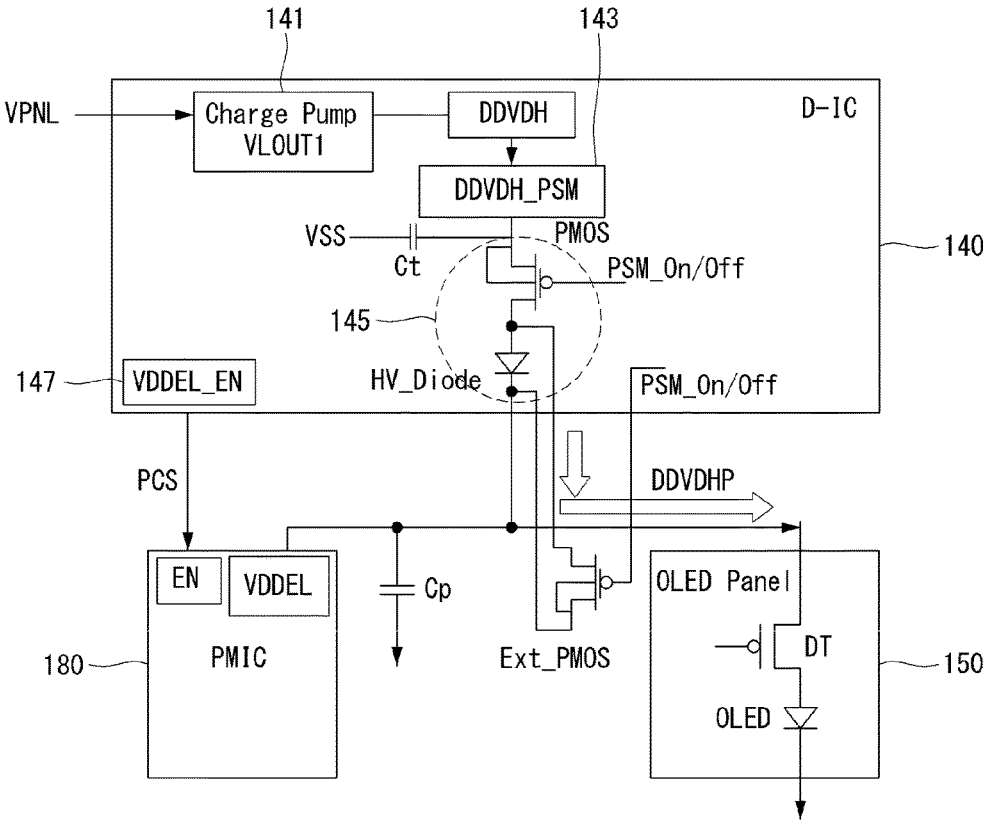
FIG. 9 is a circuit diagram illustrating a portion of a display device according to a second embodiment of the present invention.

FIG. 9 is a circuit diagram illustrating a portion of a display device according to a second embodiment of the present disclosure.

As illustrated in FIG. 9, the display device according to the second embodiment of the present disclosure includes a data driver (or a D-IC) 140, a power supply unit (or a PMIC) 180, and a display panel (or an OLED panel) 150. Other circuit units are not greatly related to the following descriptions and thus are omitted.

The data driver 140 is driven on the basis of the input power VPNL. The data driver 140 includes a driving power generating unit (charge pump) 141, an auxiliary power generating unit (or a DDVDH_PSM) 143, an auxiliary power output unit 145, and a power control unit (or a VDDEL_EN) 147.

In FIG. 9, Cp refers to a parasitic capacitor present in an output terminal of the power supply unit 180, VSS refers to a ground line, Ct refers to an output capacitor of the auxiliary power generating unit 143, DT refers to a driving transistor of a subpixel, OLED refers to an organic light emitting diode of the subpixel, EN refers to a signal input terminal of the power supply unit (or a PMIC) 180, and VDDEL refers to a first power output terminal of the power supply unit 180.

The power control unit 147 generates and outputs a power control signal PCS for controlling the power supply unit 180. The power control unit 147 outputs the power control signal PCS corresponding to logic high or logic low under the control of the auxiliary power generating unit 143.

The driving power generating unit 141 generates and outputs driving power DDVDH required for driving the data driving unit 140 on the basis of the input power VPNL. The driving power generating unit 141 may be implemented as a charge pump circuit.

The auxiliary power generating unit (or the DDVDH_PSM) 143 generates auxiliary power DDVDHP for driving the display panel 150 in a power saving mode on the basis of driving power DDVDH output from the driving power generating unit 141. When a power saving mode signal output from the outside (the timing controller or the image supply unit) is activated, the auxiliary power generating unit 143 outputs the auxiliary power DDVDHP for driving the display panel 150 in a power saving mode. The auxiliary power generating unit 143 outputs an auxiliary power output signal PSM On/Off for controlling the auxiliary power output unit 145.

The auxiliary power output unit 145 outputs the auxiliary power DDVDHP transferred from the auxiliary power generating unit 143 to the display panel 150. The auxiliary power output unit 145 outputs or does not output the auxiliary power DDVDHP under the control of the auxiliary power generating unit 143.

The auxiliary power output unit 145 included in the data driver 140 includes a first transistor PMOS, a second transistor Int_PMOS, and a diode HV_Diode. The auxiliary power output unit 145 included in the data driver 140 according to the second embodiment of the present disclosure includes the first transistor PMOS and the second transistor Int_PMOS configured as P type transistors, and the diode HV_Diode configured as a high voltage diode. The first transistor PMOS and the diode HV_Diode are positioned within the data driver 140, and the second transistor Int_PMOS is positioned outside of the data driver 140.

The first transistor PMOS is turned on or turned off in response to an auxiliary power output signal (PSM On/Off) output from the auxiliary power generating unit 143. The first transistor PMOS transfers auxiliary power DDVDHP output from the auxiliary power generating unit 143 to the second transistor Int_PMOS.

A gate electrode of the first transistor PMOS is connected to the auxiliary power output signal line of the auxiliary power generating unit 143, a first electrode thereof is connected to an output terminal of the auxiliary power generating unit 143, and a second electrode thereof is connected to an anode electrode of the diode (HV_Diode).

The second transistor Int_PMOS is turned on or turned off in response to the auxiliary power output signal PSM On/Off output from the auxiliary power generating unit 143. The second transistor Int_PMOS transfers auxiliary power DDVDHP transferred from the first transistor PMOS to an output terminal.

A gate electrode of the second transistor Int_PMOS is connected to the auxiliary power output signal line of the auxiliary power generating unit 143, a second electrode thereof is connected to the second electrode of the first transistor PMOS and an anode electrode of the diode HV_Diode, and a first electrode thereof is connected to a cathode electrode of the diode HV_Diode.

The diode HV_Diode serves to prevent first power VDDEL output from the power supply unit 180 from being introduced to the interior of the data driver 140.

When the auxiliary power output unit 145 is turned on, the data driver 140 according to the second embodiment of the present disclosure outputs auxiliary power DDVDHP generated by the auxiliary power generating unit 143 to the display panel 150. In contrast, when the auxiliary power output unit 145 is turned off, the data driver 140 does not output the auxiliary power DDVDHP generated by the auxiliary power generating unit 143 to the display panel 150.

In the second embodiment of the present disclosure, since the first transistor PMOS and the second transistor Int_PMOS are provided, output loss (voltage drop) generated by the diode HV_Diode, as well as ON resistance Ron, is lowered, reducing loss of output from the auxiliary power output unit 145.

When the display panel 150 is driven on the basis of the auxiliary power DDVDHP as in the second embodiment of the present disclosure, since output of the power supply unit 180 is turned off (that is, a power generation operation of the power supply unit is stopped), power consumption of the image supply unit (or system) may be reduced. Also, when the display panel 150 is driven using internal power of the data driver 140, power boost efficiency is improved in right loading, and since a relatively low voltage for the first power is used, power consumption of the display panel may be reduced.

Also, in the second embodiment of the present disclosure, when the display panel 150 is switched to a power saving mode, a stable voltage may be supplied to the display panel 150 with a sufficient voltage margin, compared with the experimental example, whereby the problem of a difference in color sense or appearance of mura on the screen may be solved.

Third Embodiment

Figure 10:
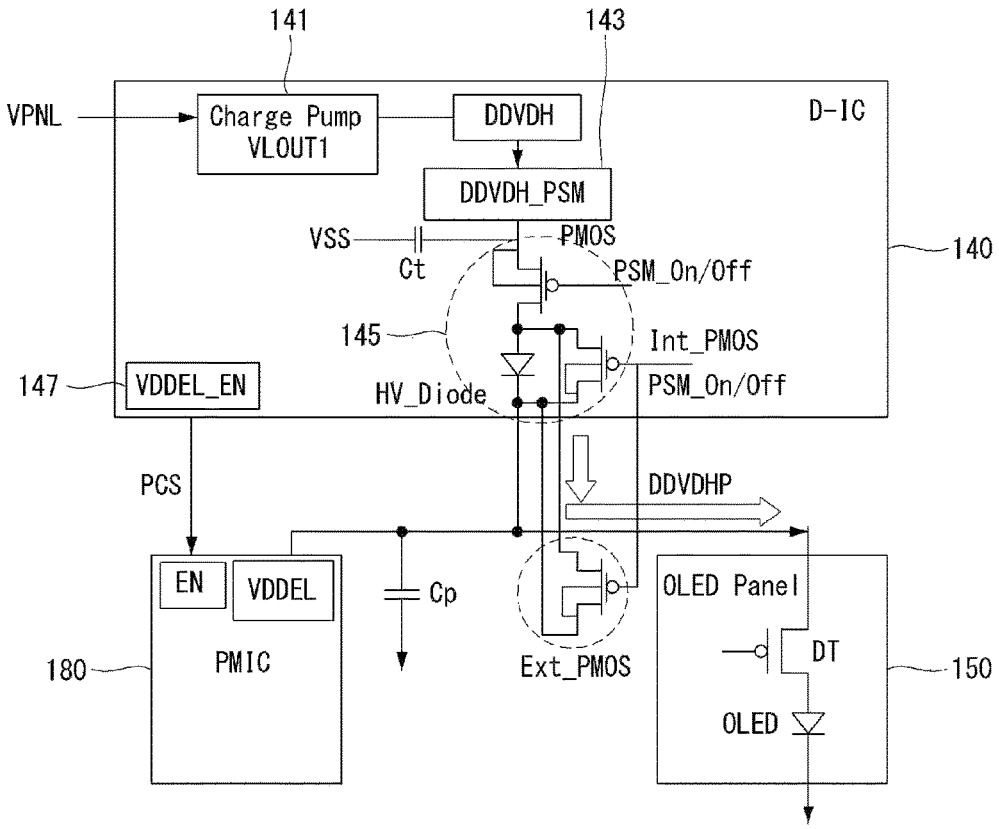
FIG. 10 is a circuit diagram illustrating a portion of a display device according to a third embodiment of the present invention.

FIG. 10 is a circuit diagram illustrating a portion of a display device according to a third embodiment of the present disclosure.

As illustrated in FIG. 10, the display device according to the third embodiment of the present disclosure includes a data driver (or a D-IC) 140, a power supply unit (or a PMIC) 180, and a display panel (or an OLED panel) 150. Other circuit units are not greatly related to the following descriptions and thus are omitted.

The data driver 140 is driven on the basis of the input power VPNL. The data driver 140 includes a driving power generating unit (charge pump) 141, an auxiliary power generating unit (or a DDVDH_PSM) 143, an auxiliary power output unit 145, and a power control unit (or a VDDEL_EN) 147.

In FIG. 10, Cp refers to a parasitic capacitor present in an output terminal of the power supply unit 180, VSS refers to a ground line, Ct refers to an output capacitor of the auxiliary power generating unit 143, DT refers to a driving transistor of a subpixel, OLED refers to an organic light emitting diode of the subpixel, EN refers to a signal input terminal of the power supply unit (or a PMIC) 180, and VDDEL refers to a first power output terminal of the power supply unit 180.

The power control unit 147 generates and outputs a power control signal PCS for controlling the power supply unit 180. The power control unit 147 outputs the power control signal PCS corresponding to logic high or logic low under the control of the auxiliary power generating unit 143.

The driving power generating unit 141 generates and outputs driving power DDVDH required for driving the data driving unit 140 on the basis of the input power VPNL. The driving power generating unit 141 may be implemented as a charge pump circuit.

The auxiliary power generating unit (or the DDVDH_PSM) 143 generates auxiliary power DDVDHP for driving the display panel 150 in a power saving mode on the basis of driving power DDVDH output from the driving power generating unit 141. When a power saving mode signal output from the outside (the timing controller or the image supply unit) is activated, the auxiliary power generating unit 143 outputs the auxiliary power DDVDHP for driving the display panel 150 in a power saving mode. The auxiliary power generating unit 143 outputs an auxiliary power output signal PSM On/Off for controlling the auxiliary power output unit 145.

The auxiliary power output unit 145 outputs the auxiliary power DDVDHP transferred from the auxiliary power generating unit 143 to the display panel 150. The auxiliary power output unit 145 outputs or does not output the auxiliary power DDVDHP under the control of the auxiliary power generating unit 143.

The auxiliary power output unit 145 included in the data driver 140 includes a first transistor PMOS, a second transistor Int_PMOS, a third transistor Ext_PMOS, and a diode HV_Diode. The auxiliary power output unit 145 included in the data driver 140 according to the third embodiment of the present disclosure includes the first transistor PMOS, the second transistor Int_PMOS, and the third transistor Ext_PMOS configured as P type transistors, and the diode HV_Diode configured as a high voltage diode. The first transistor PMOS, the second transistor Int_PMOS, and the diode HV_Diode are positioned within the data driver 140, and the third transistor Ext_PMOS is positioned outside of the data driver 140.

The first transistor PMOS is turned on or turned off in response to an auxiliary power output signal (PSM On/Off) output from the auxiliary power generating unit 143. The first transistor PMOS transfers auxiliary power DDVDHP output from the auxiliary power generating unit 143 to the second transistor Int_PMOS.

A gate electrode of the first transistor PMOS is connected to the auxiliary power output signal line of the auxiliary power generating unit 143, a first electrode thereof is connected to an output terminal of the auxiliary power generating unit 143, and a second electrode thereof is connected to an anode electrode of the diode (HV_Diode).

The second transistor Int_PMOS is turned on or turned off in response to the auxiliary power output signal PSM On/Off output from the auxiliary power generating unit 143. The second transistor Int_PMOS transfers auxiliary power DDVDHP transferred from the first transistor PMOS to an output terminal.

A gate electrode of the second transistor Int_PMOS is connected to the auxiliary power output signal line of the auxiliary power generating unit 143, a second electrode thereof is connected to the second electrode of the first transistor PMOS and an anode electrode of the diode HV_Diode, and a first electrode thereof is connected to a cathode electrode of the diode HV_Diode.

The third transistor Ext_PMOS is turned on or turned off in response to the auxiliary power output signal PSM On/Off output from the auxiliary power generating unit 143. The third transistor Ext_PMOS transfers the auxiliary power DDVDHP transferred from the first transistor PMOS to an output terminal.

A gate electrode of the third transistor Ext_PMOS is connected to the auxiliary power output signal line of the auxiliary power generating unit 143, a second electrode thereof is connected to the second electrode of the first transistor PMOS and the anode electrode of the diode HV_Diode, and a first electrode thereof is connected to the cathode electrode of the diode HV_Diode. That is, the third transistor Ext_PMOS is positioned outside of the data driver 140 and driven as a pair with the second transistor Int_PMOS.

The diode HV_Diode serves to prevent first power VDDEL output from the power supply unit 180 from being introduced to the interior of the data driver 140.

When the auxiliary power output unit 145 is turned on, the data driver 140 according to the third embodiment of the present disclosure outputs auxiliary power DDVDHP generated by the auxiliary power generating unit 143 to the display panel 150. In contrast, when the auxiliary power output unit 145 is turned off, the data driver 140 does not output the auxiliary power DDVDHP generated by the auxiliary power generating unit 143 to the display panel 150.

In the third embodiment of the present disclosure, since the first transistor PMOS, the second transistor Int_PMOS, and the third transistor Ext_PMOS are provided, output loss (voltage drop) generated by the diode HV_Diode, as well as ON resistance Ron, is lowered, reducing loss of output from the auxiliary power output unit 145.

When the display panel 150 is driven on the basis of the auxiliary power DDVDHP as in the third embodiment of the present disclosure, since output of the power supply unit 180 is turned off (that is, a power generation operation of the power supply unit is stopped), power consumption of the image supply unit (or system) may be reduced. Also, when the display panel 150 is driven using internal power of the data driver 140, power boost efficiency is improved in right loading, and since a relatively low voltage for the first power is used, power consumption of the display panel may be reduced.

Also, in the third embodiment of the present disclosure, when the display panel 150 is switched to a power saving mode, a stable voltage may be supplied to the display panel 150 with a sufficient voltage margin, compared with the experimental example, thereby the problem of a difference in color sense or appearance of mura on the screen may be solved.

As described above, when the display panel 150 is switched to a power saving mode, a stable voltage may be supplied to the display panel 150 with a sufficient voltage margin, thereby the problem of a difference in color sense or appearance of mura on the screen may be solved and power consumption may be reduced. In addition, a stable voltage may be applied to a small display device or a wearable display device using a battery as a main power source, and power consumption thereof may be reduced.

What is claimed is:

1. A data driver comprising:

an auxiliary power generating unit configured to generate an auxiliary power; and an auxiliary power output unit configured to output the auxiliary power under the control of the auxiliary power generating unit, wherein the auxiliary power output unit comprises:

a first transistor configured to output the auxiliary power output from the auxiliary power generating unit;

a diode configured to output the auxiliary power output from the first transistor;

a second transistor connected to the diode in parallel and configured to output the auxiliary power together with the diode; and a third transistor connected to the second transistor in parallel and connected to the diode in parallel, and the third transistor is configured to output the auxiliary power together with the second transistor, wherein the first transistor includes:

a gate electrode connected to an auxiliary power output signal line of the auxiliary power generating unit, a first electrode connected to an output terminal of the auxiliary power generating unit, and a second electrode connected to an anode electrode of the diode, wherein the second transistor includes:

a gate electrode connected to the auxiliary power output signal line of the auxiliary power generating unit, a first electrode connected to a cathode electrode of the diode, and a second electrode connected to the anode electrode of the diode, wherein the third transistor includes:

a gate electrode connected to the auxiliary power output signal line of the auxiliary power generating unit, a first electrode connected to the cathode electrode of the diode, and a second electrode connected to the anode electrode of the diode, wherein the first transistor, the second transistor, and the diode are positioned within the data driver, and the third transistor is positioned outside the data driver, and wherein the second transistor and the third transistor are driven as a pair using the same auxiliary power output signal output from the auxiliary power generating unit.

2. A display device comprising:

a display panel configured to display an image;

a power supply unit configured to supply a power to the display panel; and a data driver configured to:

supply a data signal to the display panel, include an auxiliary power generating unit configured to generate an auxiliary power and an auxiliary power output unit configured to output the auxiliary power under the control of the auxiliary power generating unit, and supply the auxiliary power to the display panel when the display panel is driven in a power saving mode, wherein the auxiliary power output unit includes:

a first transistor configured to output the auxiliary power output from the auxiliary power generating unit, a diode configured to output the auxiliary power output from the first transistor, a second transistor connected to the diode in parallel and configured to output the auxiliary power together with the diode, and a third transistor connected to the second transistor in parallel and connected to the diode in parallel, and the third transistor is configured to output the auxiliary power together with the second transistor, wherein the first transistor includes:

a gate electrode connected to an auxiliary power output signal line of the auxiliary power generating unit, a first electrode connected to an output terminal of the auxiliary power generating unit, and a second electrode connected to an anode electrode of the diode, wherein the second transistor includes:

a gate electrode connected to the auxiliary power output signal line of the auxiliary power generating unit, a first electrode connected to a cathode electrode of the diode, and a second electrode connected to the anode electrode of the diode, wherein the third transistor includes:

a gate electrode connected to the auxiliary power output signal line of the auxiliary power generating unit, a first electrode connected to the cathode electrode of the diode, and a second electrode connected to the anode electrode of the diode, wherein the first transistor, the second transistor, and the diode are positioned within the data driver, and the third transistor is positioned outside the data driver, and wherein the second transistor and the third transistor are driven as a pair using the same auxiliary power output signal output from the auxiliary power generating unit.

3. A display device comprising:

a display panel; and a data driver including:

an auxiliary power generating unit configured to generate an auxiliary power, and an auxiliary power output unit configured to supply the auxiliary power to the display panel when the display panel is driven in a power saving mode, wherein the auxiliary power output unit includes:

a first transistor configured to output the auxiliary power output from the auxiliary power generating unit, a diode configured to output the auxiliary power output from the first transistor, a second transistor connected to the diode in parallel and configured to output the auxiliary power to the display panel, and a third transistor connected to the second transistor in parallel and connected to the diode in parallel, and the third transistor is configured to output the auxiliary power together with the second transistor, wherein the first transistor includes:

a gate electrode connected to an auxiliary power output signal line of the auxiliary power generating unit, a first electrode connected to an output terminal of the auxiliary power generating unit, and a second electrode connected to an anode electrode of the diode, wherein the second transistor includes:

a gate electrode connected to the auxiliary power output signal line of the auxiliary power generating unit, a first electrode connected to a cathode electrode of the diode, and a second electrode connected to the anode electrode of the diode, wherein the third transistor includes:

a gate electrode connected to the auxiliary power output signal line of the auxiliary power generating unit, a first electrode connected to the cathode electrode of the diode, and a second electrode connected to the anode electrode of the diode, wherein the first transistor, the second transistor, and the diode are positioned within the data driver, and the third transistor is positioned outside the data driver, and wherein the second transistor and the third transistor are driven as a pair using the same auxiliary power output signal output from the auxiliary power generating unit.

4. The display device of claim 2, wherein the data driver is further configured to output a power control signal as a first logic for enabling the power supply unit to output the power in a normal mode and the power control signal as a second logic for causing the power supply unit not to output the power in the power saving mode, and wherein the data driver is further configured not to supply the auxiliary power to the display panel when the display panel is driven in the power saving mode.

5. The display device of claim 2, wherein the auxiliary power has a voltage level lower than the power.

6. The display device of claim 2, wherein the power supply unit generates the power on a basis of power output from a battery included in the display device, and the data driver is driven by input power generated by the battery or generated on the basis of the power output from the battery.

7. The display device of claim 6, wherein the data driver further comprises a main power generating unit configured to generate driving power required for driving the data driver based on the input power, and wherein the auxiliary power output unit generates the auxiliary power for driving the display panel in the power saving mode based on the driving power output from the main power generating unit.

8. The display device of claim 7, wherein the main power generating unit is implemented as a charge pump circuit.

* * * * *